US009482046B2

(12) United States Patent
Black

(10) Patent No.: US 9,482,046 B2
(45) Date of Patent: Nov. 1, 2016

(54) FENESTRATION COVERING TILT SYSTEM AND METHOD

(71) Applicant: Randy Lee Black, Newton, IA (US)

(72) Inventor: Randy Lee Black, Newton, IA (US)

(73) Assignee: PELLA CORPORATION, Pella, IA (US)

( * ) Notice: Subject to any disclaimer, the term of this patent is extended or adjusted under 35 U.S.C. 154(b) by 67 days.

(21) Appl. No.: 14/141,659

(22) Filed: Dec. 27, 2013

(65) Prior Publication Data

US 2015/0184453 A1 Jul. 2, 2015

(51) Int. Cl.
*E06B 9/307* (2006.01)
*E06B 9/322* (2006.01)

(52) U.S. Cl.
CPC ..... *E06B 9/307* (2013.01); *E06B 9/322* (2013.01)

(58) Field of Classification Search
CPC ..... E06B 9/30; E06B 9/303; E06B 9/307; E06B 9/308; E06B 9/322
See application file for complete search history.

(56) References Cited

U.S. PATENT DOCUMENTS 4,200,135 A * 4/1980 Hennequin ..... 160/168.1 R
4,494,593 A * 1/1985 Fielder, Jr. ..... E06B 9/307 160/177 R
4,697,630 A 10/1987 Rude
5,074,349 A 12/1991 Yannazzone
5,092,387 A 3/1992 King et al.
5,123,472 A 6/1992 Nagashima et al.
5,165,459 A 11/1992 Gaber et al.
5,662,154 A 9/1997 Drake et al.
5,839,494 A 11/1998 Judkins
5,921,306 A 7/1999 Smederod
5,934,350 A 8/1999 Ciuca
6,076,588 A 6/2000 Swiszcz et al.
6,164,362 A 12/2000 Yang
6,302,182 B1 10/2001 Anderson
6,470,637 B2 10/2002 Gratz
6,736,185 B2 5/2004 Smith et al.
6,889,933 B2 5/2005 Straaten et al.
6,945,302 B2 * 9/2005 Nien ..... 160/170
6,976,522 B2 12/2005 Strand
7,100,663 B2 9/2006 Zhang et al.
D530,558 S 10/2006 Damiano
7,137,430 B2 * 11/2006 Fraczek ..... 160/170
7,143,802 B2 12/2006 Strand et al.
7,287,569 B2 * 10/2007 Lin ..... 160/170
7,311,133 B2 12/2007 Anderson et al.
7,380,582 B1 6/2008 Anderson et al.

(Continued)

FOREIGN PATENT DOCUMENTS

EP 0273719 B2 7/1988
EP 0480429 A2 4/1992

(Continued)

*Primary Examiner* — Katherine Mitchell
*Assistant Examiner* — Scott Denion
(74) *Attorney, Agent, or Firm* — Faegre Baker Daniels LLP

(57) ABSTRACT

A window covering for a fenestration product having a viewing area includes a plurality of slats extending substantially horizontally, a ladder extending substantially vertically and supporting the slats, and a blind mechanism. The blind mechanism includes a lift mechanism and a tilt ring. The lift mechanism is operably connected to the slats to raise and lower the slats. The tilt ring is operably connected to the ladder and to the lift mechanism such that the tilt ring rotates with the lift mechanism through at least a portion of a revolution of the lift mechanism to tilt the slats when the lift mechanism rotates.

20 Claims, 8 Drawing Sheets

(56) References Cited

U.S. PATENT DOCUMENTS

| | | | | |
|---|---|---|---|---|
| 7,571,756 | B2 | 8/2009 | Smith et al. | |
| 7,654,301 | B2 | 2/2010 | Krab et al. | |
| 7,665,503 | B2 | 2/2010 | Liu | |
| 7,665,505 | B2 | 2/2010 | McCormick et al. | |
| 7,740,047 | B2 | 6/2010 | Koop et al. | |
| 7,886,803 | B2 | 2/2011 | Anderson et al. | |
| 7,921,897 | B2 | 4/2011 | Chou | |
| 7,926,541 | B2 | 4/2011 | Chou | |
| 8,151,859 | B2 | 4/2012 | Koop et al. | |
| 8,186,413 | B2 | 5/2012 | Fujita et al. | |
| 8,281,843 | B2 * | 10/2012 | Yu et al. | 160/170 |
| 9,222,302 | B2 | 12/2015 | Black | |
| 2002/0069978 | A1 * | 6/2002 | van der Wielen | 160/176.1 R |
| 2004/0004150 | A1 | 1/2004 | Straaten et al. | |
| 2004/0011475 | A1 | 1/2004 | Smith et al. | |
| 2004/0231807 | A1 | 11/2004 | Strand | |
| 2005/0045279 | A1 | 3/2005 | Zhang et al. | |
| 2006/0225849 | A1 | 10/2006 | Krab et al. | |
| 2007/0204964 | A1 | 9/2007 | Damiano | |
| 2007/0261797 | A1 | 11/2007 | Fraser et al. | |
| 2009/0065155 | A1 | 3/2009 | Liu | |
| 2009/0220353 | A1 | 9/2009 | Schwarzkopf | |
| 2010/0084099 | A1 | 4/2010 | Chou | |
| 2010/0155000 | A1 * | 6/2010 | Krab | E06B 9/307 160/171 |
| 2010/0186906 | A1 * | 7/2010 | Kraler et al. | 160/168.1 P |
| 2010/0186907 | A1 * | 7/2010 | Kraler et al. | 160/176.1 P |
| 2010/0236726 | A1 | 9/2010 | Chou | |
| 2010/0243178 | A1 | 9/2010 | Chou | |
| 2011/0094687 | A1 | 4/2011 | Fraser et al. | |
| 2011/0253321 | A1 * | 10/2011 | Yu et al. | 160/170 |
| 2012/0061031 | A1 | 3/2012 | Zhang | |
| 2013/0340952 | A1 * | 12/2013 | Kao | 160/170 |
| 2014/0238622 | A1 * | 8/2014 | Patterson et al. | 160/176.1 R |
| 2015/0033910 | A1 * | 2/2015 | Steenbergen et al. | 74/99 R |
| 2015/0184452 | A1 | 7/2015 | Black | |

FOREIGN PATENT DOCUMENTS

| | | | |
|---|---|---|---|
| EP | 480429 | B1 | 3/1997 |
| EP | 1557524 | A2 | 7/2005 |
| EP | 2434084 | A1 | 3/2012 |
| WO | 9114848 | A1 | 10/1991 |
| WO | 9208031 | A1 | 5/1992 |
| WO | 9218738 | A1 | 10/1992 |
| WO | 9736081 | A1 | 10/1997 |
| WO | 2004009942 | A1 | 1/2004 |
| WO | 2004088085 | A1 | 10/2004 |
| WO | 2007027650 | A1 | 3/2007 |

* cited by examiner

FENESTRATION COVERING TILT SYSTEM AND METHOD

BACKGROUND

Blind systems for covering fenestrations come in various styles and designs. One type of blind system, commonly called a venetian blind, typically includes a number of horizontally extending slats and a mechanism for raising and tilt the slats. The blind system can tilt the slats to increase or decrease the amount of light allowed to pass through the blind system. The blind system can also raise and lower the slats to move the slats out of the way.

Some such blind systems include one or more ladders used to support the slats. The mechanism of the blind system can tilt the slats by raising and lowering opposite cords of the ladders that support the slats. Such mechanisms can be complex and prone to poor performance or failure. For example, in some systems the ladder can include one or more cords loosely attached to the mechanism so as to allow relative movement between the cords and the mechanism. Amount of friction between the cords and the mechanism can be difficult to control, resulting in too great or too little friction for proper operation. This can result in poor performance and even failure of the blind mechanism.

SUMMARY

According to one embodiment, a window covering for a fenestration product having a viewing area includes a plurality of slats extending substantially horizontally, a ladder extending substantially vertically and supporting the slats, and a blind mechanism. The blind mechanism includes a lift mechanism and a tilt ring. The lift mechanism is operably connected to the slats to raise and lower the slats. The tilt ring is operably connected to the ladder and to the lift mechanism such that the tilt ring rotates with the lift mechanism through at least a portion of a revolution of the lift mechanism to tilt the slats when the lift mechanism rotates.

Another embodiment is a window covering for a fenestration product having a viewing area. The window covering includes a plurality of slats extending substantially horizontally, a ladder extending substantially vertically and supporting the slats, and a blind mechanism. The blind mechanism includes a lift mechanism operably connected to the slats to raise and lower the slats and a tilt ring operably connected to the ladder and to the lift mechanism such that the tilt ring is rotationally secured to the lift mechanism during a tilting operation and is rotationally decoupled from the lift mechanism during a lifting operation.

Another embodiment is a tilt ring for uses in a tilt mechanism of a window covering for a fenestration product having a viewing area. The tilt ring includes a ladder spool and a flange adjacent to and extending radially outward of the ladder spool. The flange defines first and second spaces. A first ladder hook is positioned in the first space and a second ladder hook positioned in the second space. An inner surface defines a hole and having a plurality of friction pads extending radially inward.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
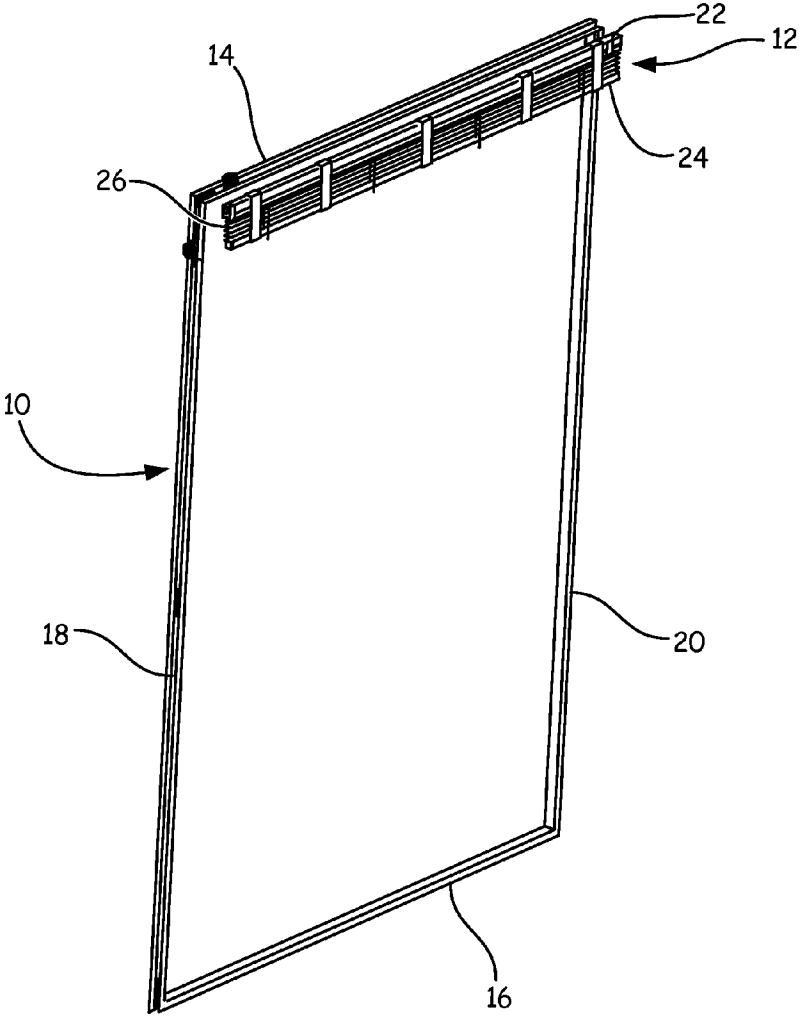
FIG. 1 is a perspective view of a fenestration and a blind system.

FIG. 1 is a perspective view of a fenestration 10 and a blind system 12. In the illustrated embodiment, fenestration 10 is a window having a frame with a frame top 14, a frame bottom 16, and frame sides 18 and 20. In other embodiments, fenestration 10 can be a door or other fenestration. The blind system 12 includes a top rail 22, a bottom rail 24, and a plurality of slats 26. In the illustrated embodiment, the slats 26 are horizontally extending venetian blind slats. The top rail 22 is mountable to the frame top 14 between the frame sides 18 and 20. The top rail 22 contains a blind mechanism (not shown in FIG. 1) for tilting and lifting the slats 26 and the bottom rail 24.

Figure 2:
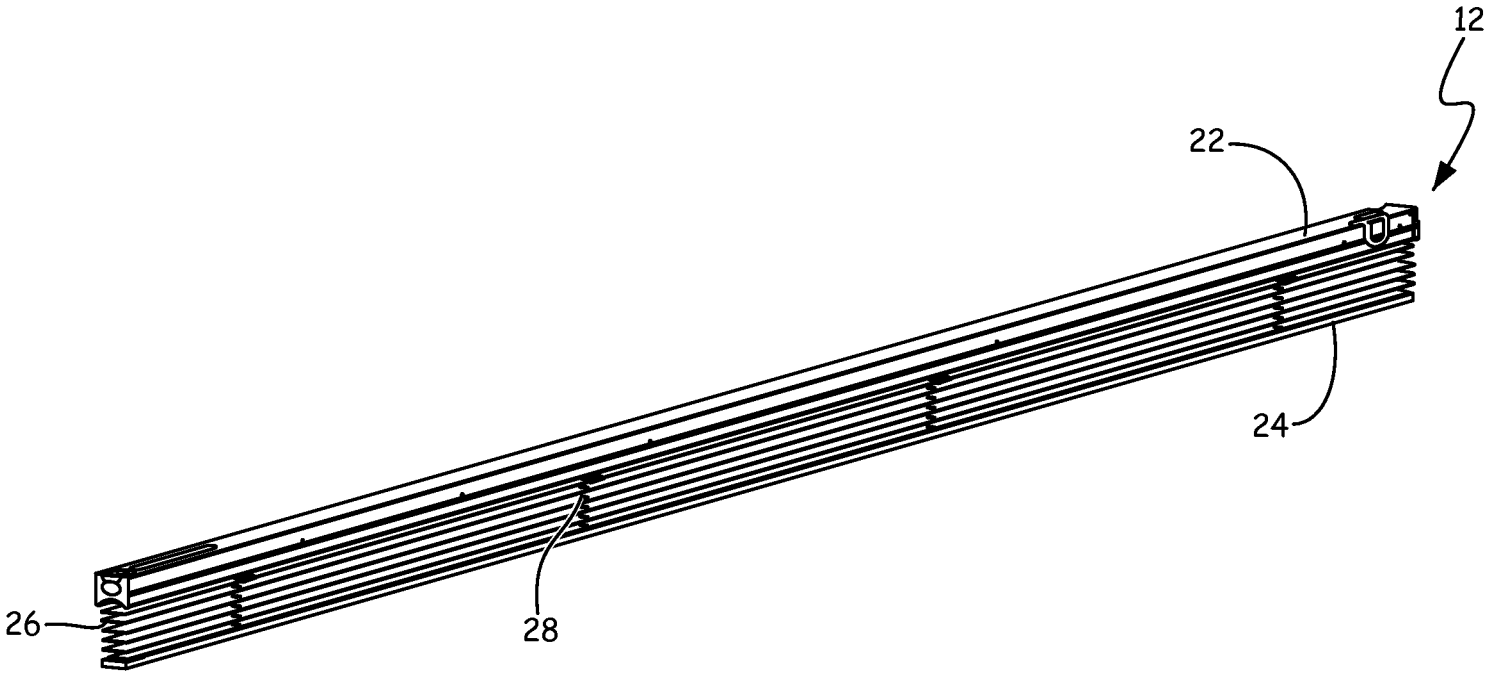
FIG. 2 is a perspective view of the blind system of FIG. 1.

FIG. 2 is a perspective view of the blind system 12. The slats 26 include holes 28 through which a lift cord (not shown) extends. The lift cord connects to the bottom rail 24 for lifting and raising the bottom rail 24 and the slats 26. The blind system 12 also includes ladders (shown in FIG. 3) that support the slats 26. The ladders can be positioned proximate, without extending through, each set of the holes 28.

Figure 3:
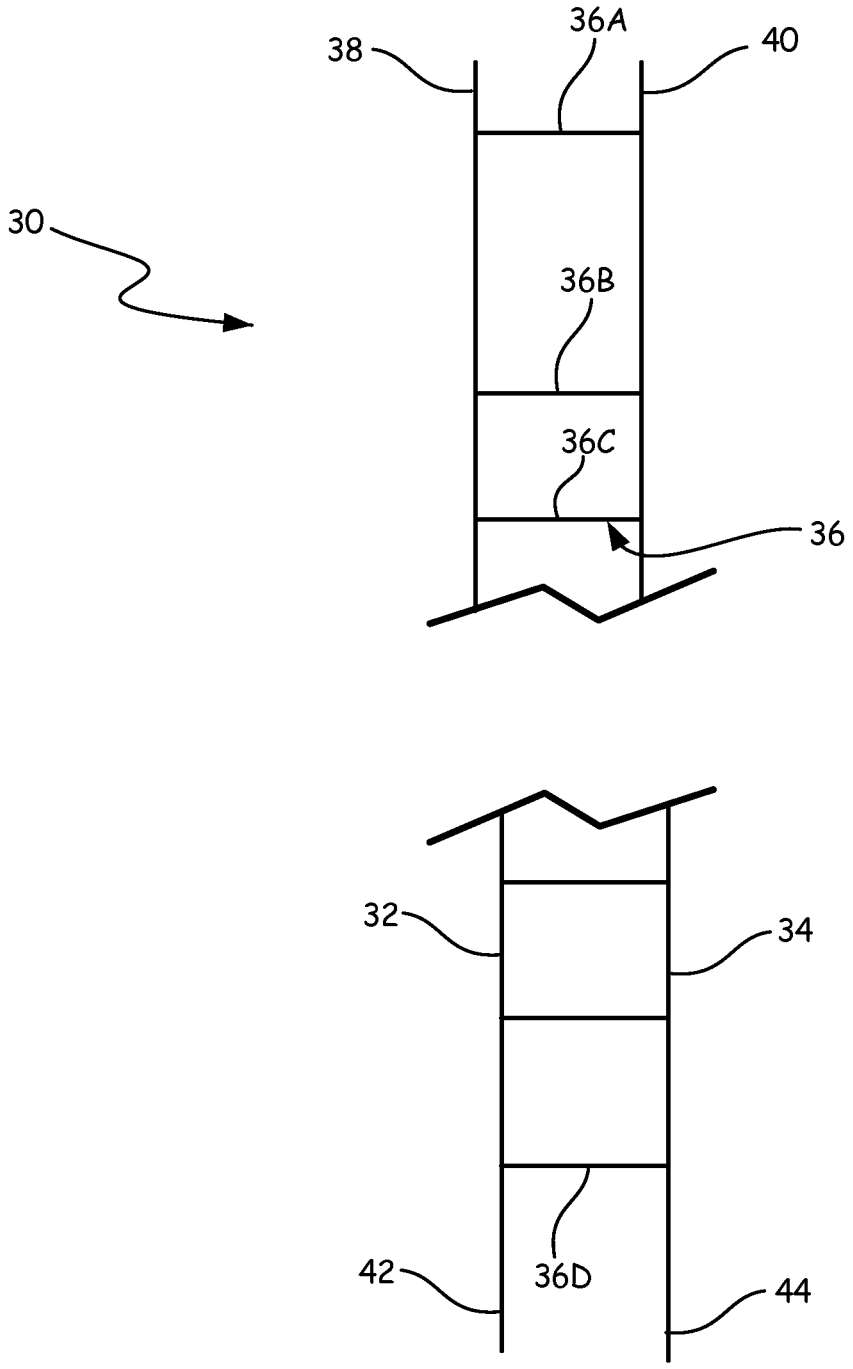
FIG. 3 is a side view of a ladder for use with the blind system of FIGS. 1 and 2.

FIG. 3 is a side view of a ladder 30 for use with the blind system 12 (shown in FIGS. 1 and 2). In the illustrated embodiment, the ladder 30 is a cord ladder including ladder cords 32 and 34 and rungs 36. The ladder cords 32 and 34 extend substantially vertically from the top rail 22 to the bottom rail 24 (shown in FIGS. 1 and 2). The rungs 36 extend substantially horizontally between the ladder cords 32 and 34. The slats 26 (shown in FIGS. 1 and 2) rest on and are supported by the rungs.

In the illustrated embodiment, the rungs 36 include a top rung 36A and a second rung 36B spaced from the top rung 36A by a gap. A rung (not shown) has been removed between the top rung 36A and the second rung 36B such that the gap between the top rung 36A and the second rung 36B is substantially greater than a normal gap, such as the gap between the second rung 36B and a third rung 36C. For example, in one embodiment the gap between the top rung 36A and the second rung 36B can be about double the normal gap. In another embodiment, the gap between the top rung 36A and the second rung 36B can be five times the normal gap or more. The gap between the top rung 36A and the second rung 36B can facilitate connection to a tilt mechanism (not shown in FIG. 3B).

In the illustrated embodiment, the ladder cords 32 and 34 include tails 38 and 40, respectively, extending above the top rung 36A and include tails 42 and 44, respectively, extending below a bottom rail 36D. In alternative embodiments, the tails 38, 40, 42, and 44 can be omitted.

Figure 4:
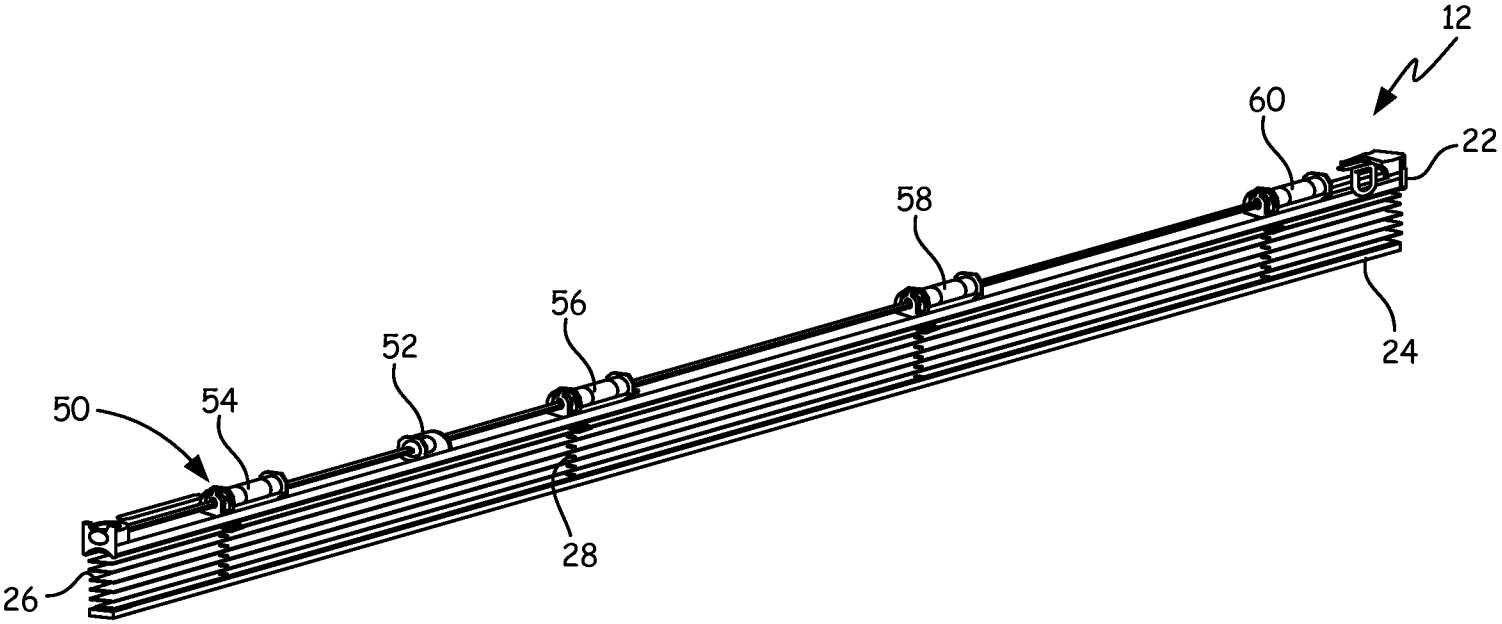
FIG. 4 is a perspective view of the blind system of FIGS. 1 and 2 with a top rail open.

FIG. 4 is a perspective view of the blind system 12 with the top rail 22 open. The top rail 22 contains a blind mechanism 50. The blind mechanism 50 include a brake mechanism 52 as well as lift and tilt mechanisms 54, 56, 58, and 60 all mounted to and connected by a common horizontally extending shaft 62. In the illustrated embodiment, the blind mechanism 50 includes four lift and tilt mechanisms 54, 56, 58, and 60 each aligned with a set of the holes 28 in the slats 26. In alternative embodiments, the blind mechanism 50 can include more or less than four lift and tilt mechanisms suitable for the application.

Figure 5:
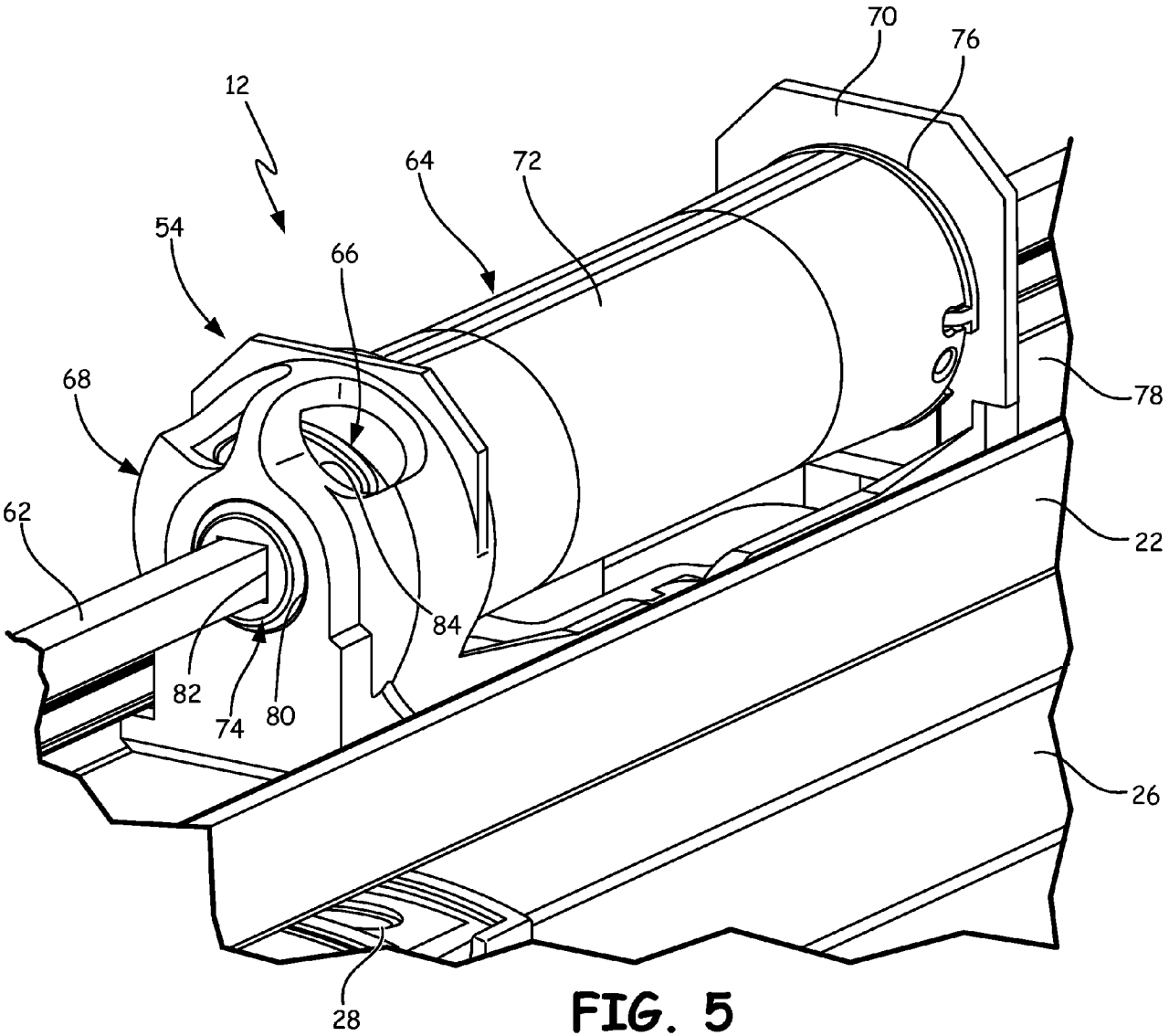
FIG. 5 is an enlarged perspective view of a lift and tilt mechanism used in the blind system of FIGS. 1, 2, and 4.

FIG. 5 shows an enlarged perspective view of the lift and tilt mechanism 54. The lift and tilt mechanism 54 includes a lift spool 64, a tilt ring 66, a spool base 68, and a spool retainer support 70. The lift spool 64 has a tapered cylinder 72 extending substantially horizontally. A lift cord (not shown) can be wrapped around the lift spool 64 for raising and lowering the slats 26 when the shaft 62 and the lift spool 64 rotate. When the slats are raised or lowered to a desired height, the brake mechanism 52 (shown in FIG. 4) can stop and hold the lift cord and the slats 26 at that height.

A spool axle 74 extends substantially horizontally from a first end of the lift spool 64 and an end cap 76 covers a second end of the lift spool 64. In the illustrated embodiment, the spool axle 74 is integrally formed with the tapered cylinder 72. In alternative embodiments, the spool axle 74 can be formed separately from the tapered cylinder 72.

The spool retainer support 70 and the spool base 68 are mounted in a mounting channel 78 of the top rail 22 to rotatably support the lift spool 64 with respect to the top rail 22. The spool retainer support 70 rotatably supports the end cap 76 and the second end of the lift spool 64. The spool base 68 includes a horizontally extending hole 80 sized to receive and support the spool axle 74. The hole 80 and the spool axle 74 can be substantially axisymmetric to allow the spool axle 74 to rotate with respect to the spool base 68.

The spool axle 74 includes a horizontally extending hole 82 sized to receive and support the shaft 62. The hole 82 and the shaft 62 can be non-axisymmetric such that the spool axle 74 rotates with the shaft 62. In the illustrated embodiment, the hole 82 and the shaft 62 have a square cross section. In alternative embodiments, the hole 82 and the shaft 62 can be keyed with a different cross section.

The spool base 68 includes a stop 84 that interacts with the tilt ring 66 so as to limit rotation of the tilt ring 66 when the lift spool 64 rotates. The tilt ring 66 can be positioned at least partially inside a cavity defined by the spool base 68. The tilt ring 66 can rotate with the lift spool 64 up to the extent where rotation of the tilt ring 66 is limited by the spool base 68.

Figure 6:
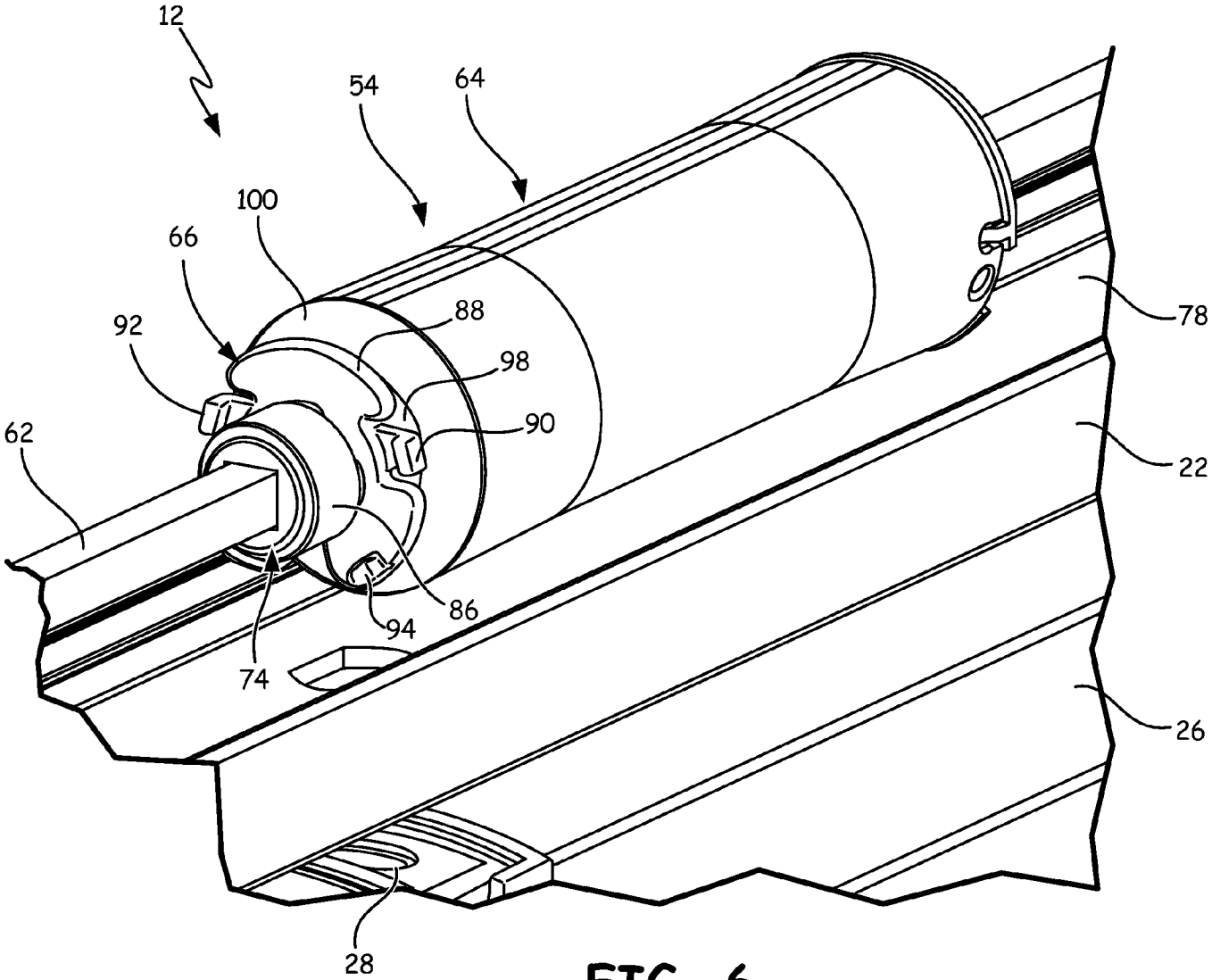
FIG. 6 is a perspective view of the lift and tilt mechanism of FIG. 5 with a spool base and a spool retainer support removed.

FIG. 6 is a perspective view of the lift and tilt mechanism 54 with the spool base 68 and the spool retainer support 70 (shown in FIG. 5) removed. The spool axle 74 has an outer surface 86 upon which the tilt ring 66 is mounted via an interference friction fit. In the illustrated embodiment, the outer surface 86 is substantially cylindrical.

The tilt ring 66 includes a flange 88, hooks 90 and 92, stops 94 and 96 (with the stop 96 obscured in FIG. 6), and a ladder spool 98. The flange 88 is adjacent to and extends radially outward of the ladder spool 98. The flange 88 can help retain the ladder 30 (shown in FIG. 3) on the ladder spool 98.

In the illustrated embodiment, the tilt ring 66 has a single flange 88 such that the ladder spool 98 extends between the flange 88 and a radially extending surface 100 of the lift spool 64. In alternative embodiment, the tilt ring 66 can have a second flange opposite the flange 88.

Figure 7:
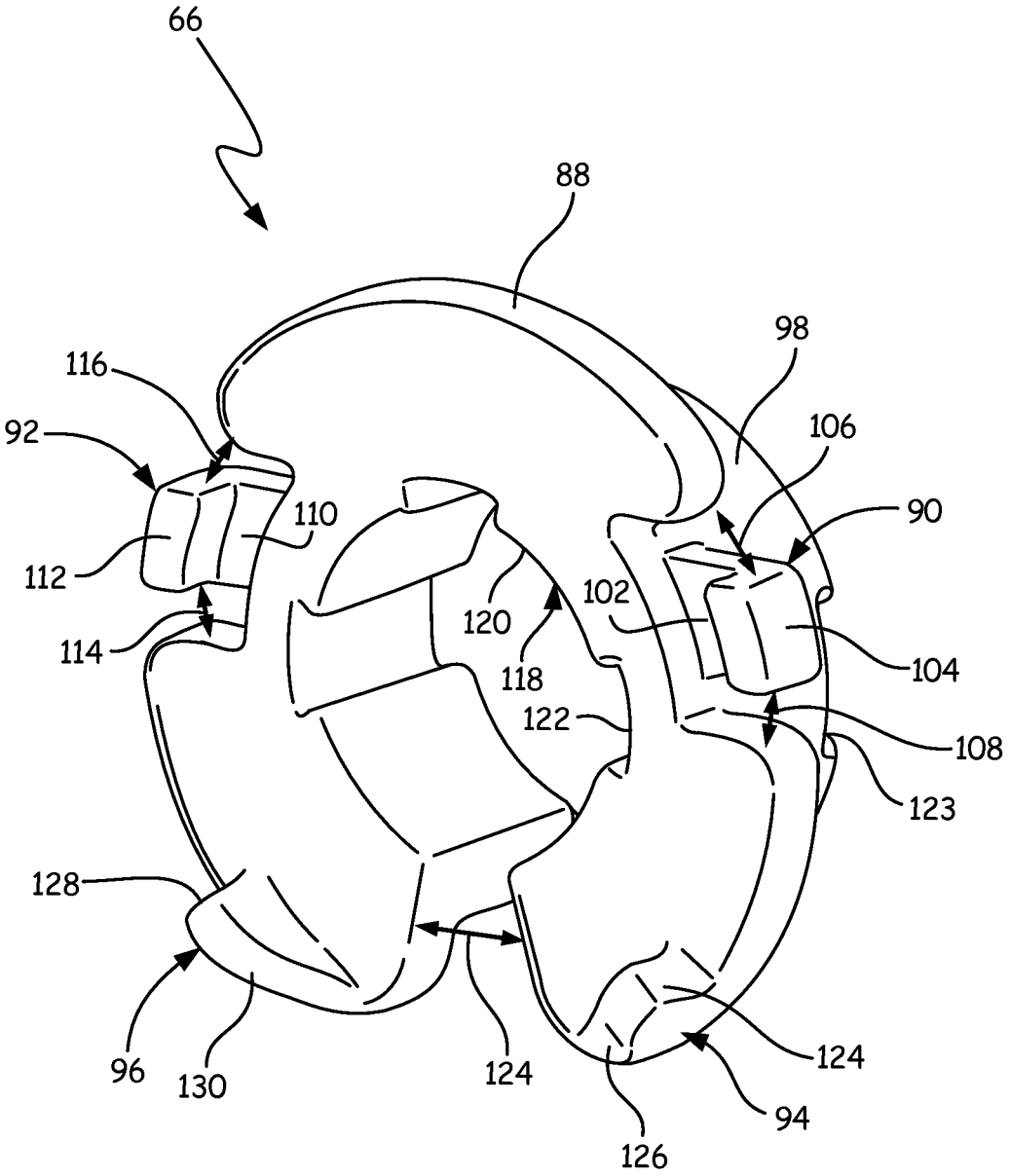
FIG. 7 is a perspective view of a tilt ring used in the lift and tilt mechanism of FIGS. 5 and 6.

FIG. 7 is a perspective view of the tilt ring 66. As shown in FIG. 7, the hook 90 includes a radially extending portion 102 and an axially extending portion 104 extending from a radially outer end of the radially extending portion 102. The hook 90 is positioned in a space defined by the flange 88 with gaps 106 and 108 between the hook 90 and the flange 88. The hook 92 includes a radially extending portion 110 and an axially extending portion 112 extending from a radially outer end of the radially extending portion 110. The hook 92 is positioned in a space defined by the flange 88 with gaps 114 and 116 between the hook 92 and the flange 88. In alternative embodiments, the hooks 90 and 92 can be configured, positioned, and/or oriented differently than as illustrated. For example, the hook 90 could extend in a single direction as opposed to including both the radially extending portion 102 and the axially extending portion 104. The ladder 30 can attach to the tilt ring 66 by attaching the ladder 30 to the hooks 90 and 92. The top rung 36A (shown in FIG. 3) can be attached to the hooks 90 and 92 by inserting the top rung 36A into the gaps 106, 108, 114, and 116.

The tilt ring 66 has an inner surface 118 defining a hole for receiving the spool axle 74 (shown in FIG. 6). The inner surface 118 includes a plurality of friction pads 120 spaced by and extending radially inward of a plurality of grooves 122. The friction pads 120 provide friction contact with the outer surface 86 (shown in FIG. 6) of the spool axle 74. The quantity, size, shape, and orientation of the friction pads 120 and the grooves 122 can be adjusted to increase or decrease friction as appropriate for an application.

The grooves 122 extend substantially axially along the inner surface 118 from the flange 88 to an edge of the ladder spool 98 that is opposite of the flange 88. The grooves 122 connect to grooves 123, which extend radially outward from the grooves 122 along the edge of the ladder spool 98 that is opposite of the flange 88.

In the illustrated embodiment, the friction pads 118 each have a concave curvature with an arc radius that is larger than an actual radius of the holed defined by the inner surface 118. This can allow for center portions of the friction pads 120 to more reliably contact the outer surface 86 of the spool axle 74, thus resulting in a more reliable friction force.

The radius of the inner surface 118 of the tilt ring 66 can be slightly smaller than the radius of the outer surface 86 of the spool axle 74. This can allow for an interference or friction fit. In the illustrated embodiment, the tilt ring 66 defines a gap 124 in the tilt ring 66 which is located between the stops 94 and 96. The gap 124 results in the tilt ring 66 being substantially C-shaped and facilitates increased flexibility of the tilt ring 66. In other embodiments, the gap 124 can be omitted and the tilt ring 66 can be substantially toroidal.

The stops 94 and 96 extend from the flange 88 of the tilt ring 66 in an axial direction. The stop 94 includes a substantially flat side 124 and a tapered side 126 opposite the flat side 124. The flat side 124 extends in a substantially radial and axial plane that is normal to a circumferential direction. The stop 96 includes a substantially flat side 128 and a tapered side 130 opposite the flat side 128. The flat side 128 extends in a substantially radial and axial plane that is different than that of the flat side 124 and that is normal to the circumferential direction. In the illustrated embodiment, the tilt ring 66 includes two stops 94 and 96. In alternative embodiments, the tilt ring 66 can include a single stop.

The tilt ring 66 can be rotationally secured to the lift spool 64 during a tilting operation and rotationally decoupled from the lift spool 64 during a lifting operation. In operation with the tilt ring 66 mounted on the spool axle 74, when the lift spool 64 rotates, static friction between the tilt ring 66 and the spool axle 74 can cause the tilt ring 66 to also rotate in the same direction at the same rate. If and when the tilt ring 66 rotates in a first rotational direction so far that the stop 94 of the tilt ring 66 abuts the stop 84 of the spool base 68, rotation of the tilt ring 66 can cease and rotation of the lift spool 64 can continue so long as force is great enough to overcome static friction initially between the tilt ring 66 and the spool axle 74 and also dynamic friction between the tilt ring 66 and the spool axle 74 during rotation. Similarly, if and when the tilt ring 66 rotates so far in an opposite rotational direction that the stop 96 of the tilt ring 66 abuts the stop 84 of the spool base 68, rotation of the tilt ring 66 can cease and rotation of the lift spool 64 can continue. Thus, the lift spool 64 can perform a number of rotations to extend or retract the lift cord so as to lower or raise the slats 26 (shown in FIGS. 1, 2, and 4) without subjecting the tilt ring 66 to the same number of rotations as that of the lift spool 64 when the lift spool 64 raises or lowers the slats 26. Instead, the tilt ring 66 can be limited to a range of motion suitable for tilting the ladder 30 and associated slats 26. In the illustrated embodiment, the range of motion of the tilt ring 66 is about 270 degrees. In alternative embodiments, the range of motion of the tilt ring 66 can be increased or decreased to a different range of motion suitable for tilting operation.

Figure 8:
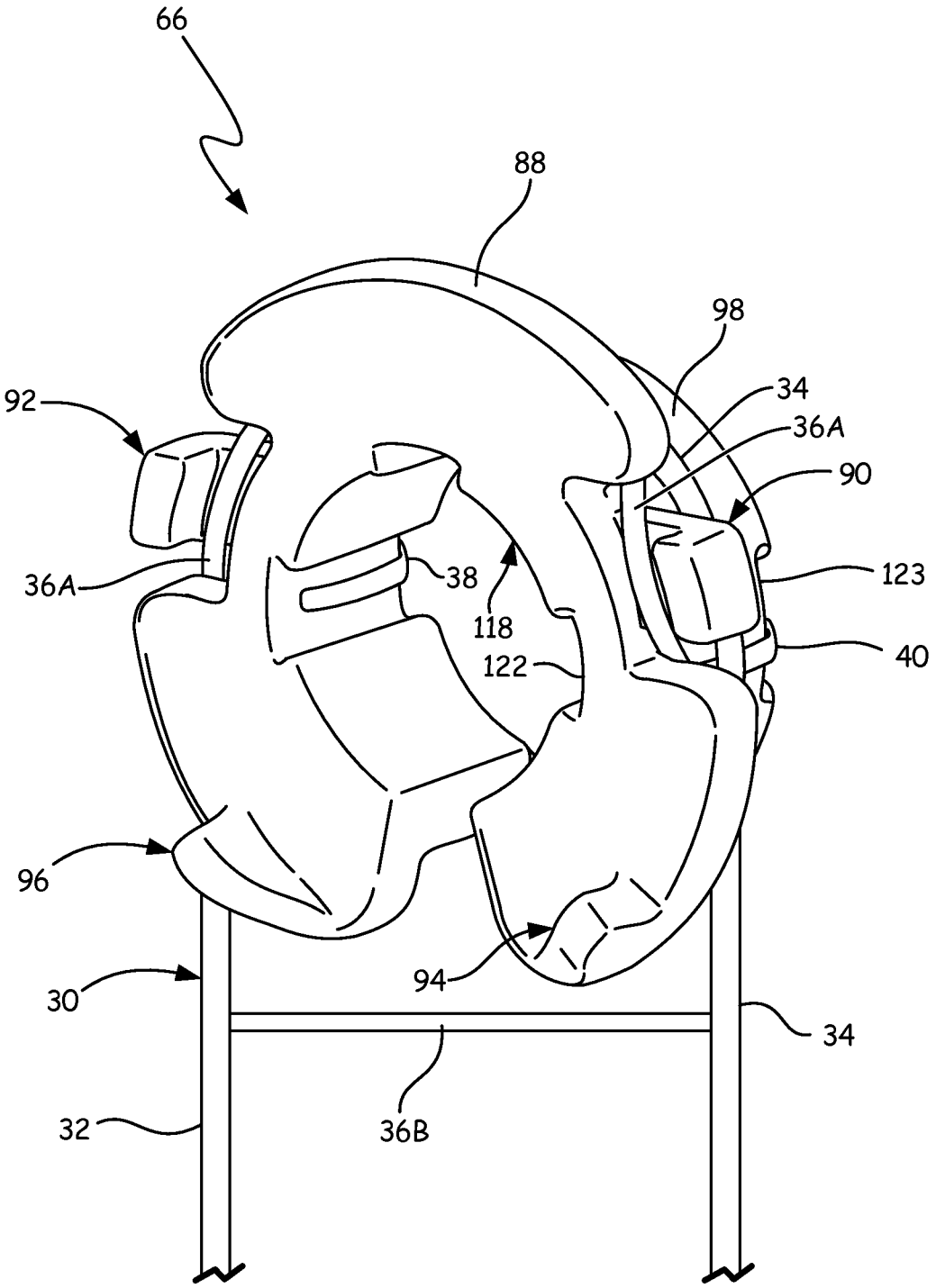
FIG. 8 is a perspective view of the tilt ring of FIG. 7 with the ladder of FIG. 3 attached.

FIG. 8 is a perspective view of the tilt ring 66 with the ladder 30 attached. As shown in FIG. 8, the ladder 30 is attached to the tilt ring 66 with the top rung 36A attached to the hooks 90 and 92. The top rung 36A is attached to the hooks 90 and 92 by looping the top rung 36 into and out of the gaps 106, 108, 114, and 116 between the hooks 90 and 92 and the flange 88. The gaps 106, 108, 114, and 116 can be sized large enough to allow insertion of the top rung 36A and sized small enough to discourage or prevent insertion of the ladder cords 32 and 34. The ladder cords 32 and 34 can be looped around the ladder spool 98. In some embodiments, the ladder cords 32 and 34 can be looped around the ladder spool 98 one time. In other embodiments, the ladder cords 32 and 34 can be looped around the ladder spool 98 two or more times.

In the illustrated embodiment, the tails 38 and 40 extend across the ladder spool 98 and are folded and tucked into the grooves 122 and 123. For example, the tail 40 is folded into the groove 123 and further into one of the grooves 122 to be positioned between the inner surface 118 of the tilt ring 66 and the outer surface 86 of the spool axle 74 so as to be tucked out of the way.

When the lift spool 64 (shown in FIGS. 4-6) rotates, the tilt ring 66 goes through a partial revolution that raise one and lowers the other of the ladder cords 32 and 34, thus tilting the slats 26 (shown in FIGS. 1, 2, and 4). By limiting rotation of the tilt ring 66, motion of the ladder cords 32 and 34 can be controlled to desired limits. Friction between the tilt ring 66 and the spool axle 74 can be controlled to be great enough to tilt the slats 26 and yet light enough to allow rotation of the lift spool 64 without the tilt ring 66 once the tilt ring 66 reaches its rotation limits. This can yield a relatively simple, reliable, and convenient blind mechanism 50 for both lifting and tilting the slats 26 using a common shaft.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A window covering for a fenestration product having a viewing area, the window covering comprising:
- a plurality of slats extending substantially horizontally;
- a ladder extending substantially vertically and supporting the slats; and
- a blind mechanism comprising:
  - a lift mechanism operably connected to the slats to raise and lower the slats; and
  - a tilt ring operably connected to the ladder and to the lift mechanism such that the tilt ring rotates with the lift mechanism through at least a portion of a revolution of the lift mechanism to tilt the slats when the lift mechanism rotates, the tilt ring including a plurality of discrete radially inwardly projecting friction pads defining an inner contact surface of the tilt ring, each inner contact surface configured to have a different arc radius than an arc radius of a spool axle.

2. The window covering of claim 1, wherein the lift mechanism comprises a lift spool with a lift cord wrapped around the lift spool for raising and lowering the slats, and wherein the tilt ring is mounted to the lift spool in friction engagement.

3. The window covering of claim 2, wherein the lift spool includes a spool axle extending axially from the lift spool and wherein the inner contact surface of the tilt ring is mounted in friction engagement with an outer surface of the spool axle.

4. The window covering of claim 2, wherein the friction pads are in friction contact with the lift spool.

5. The window covering of claim 4, wherein the friction pads are spaced by and extend radially inward of grooves and wherein the ladder includes first and second tails tucked in the grooves between the tilt ring and the lift spool.

6. The window covering of claim 1, wherein the tilt ring comprises a ladder spool and a flange extending radially outward from the ladder spool, wherein the blind mechanism comprises a first stop positioned with respect to a second stop extending from the flange of the tilt ring so as to limit rotation of the tilt ring.

7. The window covering of claim 1, wherein the ladder comprises first and second ladder cords and a plurality of rungs extending from the first ladder cord to the second ladder cord, wherein the plurality of rungs includes a top rung, wherein the tilt ring includes a first hook, and wherein the top rung is attached to the tilt ring at the first hook.

8. The window covering of claim 7, wherein the first hook comprises a substantially radially extending portion and a substantially axially extending portion connected to a radially outer end of the substantially radially extending portion.

9. The window covering of claim 7, wherein the tilt ring comprises a flange extending substantially radially outward and defining first and second spaces, wherein the first hook is positioned in the first space, wherein the tilt ring comprises a second hook positioned in the second space, and wherein the top rung is attached to the tilt ring at the first and second hooks.

10. The window covering of claim 9, wherein the top rung extends through first and second gaps between the first hook and the flange and extends through third and fourth gaps between the second hook and the flange.

11. The window covering of claim 9, wherein the tilt ring comprises a ladder spool, wherein the first and second ladder cords are wrapped at least partially around the ladder spool without being wrapped around the first and second hooks.

12. The window covering of claim 11, wherein the ladder spool extends from the flange of the tilt ring to a radially extending surface of the lift spool.

13. The window covering of claim 7, wherein the plurality of rungs includes a second rung adjacent to the top rung and is spaced from the top rung by a first gap and further wherein the plurality of rungs includes a third rung and a fourth rung adjacent the third rung and spaced from the third rung by a second gap that is greater than the first gap.

14. A window covering for a fenestration product having a viewing area, the window covering comprising:

a plurality of slats extending substantially horizontally;

a ladder extending substantially vertically and supporting the slats; and a blind mechanism comprising:

a lift mechanism operably connected to the slats to raise and lower the slats; and a tilt ring operably connected to the ladder and to the lift mechanism, such that the tilt ring is rotationally secured to the lift mechanism during a tilting operation and is rotationally decoupled from the lift mechanism during a lifting operation, the tilt ring including a plurality of discrete radially inwardly projecting friction pads defining an inner contact surface of the tilt ring, each inner contact surface configured to have a different arc radius than an arc radius of a spool axle and a gap such that the tilt ring is substantially C-shaped.

15. The window covering of claim 14, wherein the ladder comprises first and second ladder cords and a plurality of rungs extending from the first ladder cord to the second ladder cord, wherein the plurality of rungs includes a top rung, wherein the tilt ring includes a first hook, and wherein the top rung is attached to the tilt ring at the first hook.

16. The window covering of claim 14, wherein the blind mechanism comprises a first stop positioned with respect to a second stop on the tilt ring so as to limit rotation of and rotationally decouple the tilt ring from the lift mechanism when the first stop contacts the second stop.

17. The window covering of claim 1, wherein the tilt ring comprises:

a ladder spool;

a flange adjacent to and extending radially outward of the ladder spool, wherein the flange defines first and second spaces;

a first ladder hook positioned in the first space; and a second ladder hook positioned in the second space.

18. The window covering of claim 14, wherein the friction pads are each curved with an arc radius that is greater than a radius of the hole defined by the inner surface.

19. The window covering of claim 17, wherein the tilt ring further comprises:

a first stop extending substantially axially from the flange; and a second stop extending substantially axially from the flange and spaced from the first stop, wherein the first stop and second stop are separated by the gap.

20. The window covering of claim 17, wherein the first hook comprises a first substantially radially extending portion and a first substantially axially extending portion connected to a first radially outer end of the first substantially radially extending portion and wherein the second hook comprises a second substantially radially extending portion and a second substantially axially extending portion connected to a second radially outer end of the second substantially radially extending portion.

* * * * *